US010060707B2

(12) United States Patent
Searle et al.

(10) Patent No.: US 10,060,707 B2
(45) Date of Patent: Aug. 28, 2018

(54) PROTECTIVE GARMENT WITH AN INFLATABLE FLOATATION BLADDER

(71) Applicant: BCB International Limited, South Glamorgan (GB)

(72) Inventors: Matthew Searle, Somerset (GB); Christopher Mark Lewis, Rhondda Cynon Taff (GB)

(73) Assignee: BCB International Limited, Tremorfa, Cardiff, South Glamorgan (GB)

( * ) Notice: Subject to any disclaimer, the term of this patent is extended or adjusted under 35 U.S.C. 154(b) by 547 days.

(21) Appl. No.: 14/724,710

(22) Filed: May 28, 2015

(65) Prior Publication Data

US 2015/0345910 A1 Dec. 3, 2015

(51) Int. Cl.

| | |
|---|---|
| ***A63C 9/08*** | (2012.01) |
| ***F41H 1/02*** | (2006.01) |
| ***A41D 1/04*** | (2006.01) |

(52) U.S. Cl.

CPC ..... *F41H 1/02* (2013.01); *A41D 1/04* (2013.01); *A41D 2600/00* (2013.01)

(58) Field of Classification Search

CPC ..... A63C 9/155; F41H 1/02

See application file for complete search history.

(56) References Cited

U.S. PATENT DOCUMENTS 4,097,947 A 7/1978 Kiefer
5,584,737 A * 12/1996 Luhtala ..... A41D 13/0125 2/2.5
6,681,399 B1 * 1/2004 Kerr ..... A41D 13/0125 2/2.5
7,080,411 B2 7/2006 Kerr
8,397,312 B1 * 3/2013 Crye ..... F41H 1/02 2/2.5

(Continued)

FOREIGN PATENT DOCUMENTS

EP 2261592 12/2010
EP 2727815 5/2014

(Continued)

*Primary Examiner* — Stephen P Avila
(74) *Attorney, Agent, or Firm* — Workman Nydegger

(57) ABSTRACT

An armour vest includes front and rear portions that realize or otherwise mount armour plate or soft armour pads over a wearer's vital organs. A floatation bladder is stored and deployed under the protection of the armour. The armour vest is expandable to accommodate and at least partially protect the floatation bladder when it is inflated. In either a single or multi-stage process, the armour vest's volume is increased by automatically releasing buckles that increase separation between the front and rear portions around the waist and, in an embodiment, also at the shoulders of the armour vest. In a deflated state, shoulder connectors provide a load-bearing connection between the front and rear portions of the armour vest. Inflation of the bladder, either manually actuated by pulling a webbing trigger handle or automatically with immersion, causes a different load-bearing shoulder bridge to be brought into operation at the shoulders of the amour vest. The shoulder bridge is realized by the taking up of folds of fabric, which folds are released with the breaking of the buckle connection. Increased comfort and manoeuvrability are therefore afforded to the wearer of the vest.

11 Claims, 6 Drawing Sheets

(56) References Cited

U.S. PATENT DOCUMENTS

| | | | | |
|---|---|---|---|---|
| 9,248,893 | B2 * | 2/2016 | Hellweg | B63C 9/1255 |
| 9,869,532 | B2 * | 1/2018 | Kent | F41H 1/02 |
| 2003/0146348 | A1 * | 8/2003 | Douglas | B64D 17/30 244/151 R |
| 2010/0313392 | A1 | 12/2010 | Anscher | |
| 2012/0289106 | A1 | 11/2012 | Kent | |
| 2016/0347431 | A1 * | 12/2016 | Kent | B63C 9/1255 |
| 2017/0356724 | A1 * | 12/2017 | Richardson | F41H 5/013 |
| 2018/0045489 | A1 * | 2/2018 | Swan | F41H 1/02 |
| 2018/0128577 | A1 * | 5/2018 | Beck | F41H 5/013 |

FOREIGN PATENT DOCUMENTS

| | | |
|---|---|---|
| GB | 2333223 | 7/1999 |
| WO | 9727101 | 7/1997 |
| WO | 2006060031 | 6/2006 |
| WO | 2010007343 | 1/2010 |

* cited by examiner

PROTECTIVE GARMENT WITH AN INFLATABLE FLOATATION BLADDER

CROSS-REFERENCE TO RELATED APPLICATIONS

This application claims priority to and the benefit of Great Britain Patent Application No. 1500455.9, entitled "Protective Garment with an Inflatable Floatation Bladder", filed on Jan. 12, 2015, and Great Britain Patent Application No. 1409842.0, entitled "Protective Garment with an Inflatable Floatation Bladder", filed on Jun. 3, 2014. All of the aforementioned applications are incorporated by reference herein in their entirety.

FIELD OF THE INVENTION

This invention relates, in general, to body armour that provides a protective shield against general bodily injury or acute trauma. More particularly, but not exclusively, the present invention relates to personal body armour that can provide ballistic protection against projectile threats, such as high velocity rifle rounds, and which personal body armour is used in conjunction with an inflatable floatation bladder that is deployed in water to prevent sinking

SUMMARY OF THE PRIOR ART

Security personnel, including policemen, infantry soldiers and special operations forces, are often now equipped with tactical protection in the form of body armour or protective vests to mitigate injury from attack. Such body armour is available in a variety of forms to address varying levels of potential threat, e.g. from bullets and knives.

So-called "soft armour" is worn in the form of jackets and vests and is composed of assemblies of ballistic fibres, such as those formed multiple layers of Kevlar® such as supplied from the DuPont Company.

Typically, soft armour will employ fifteen to thirty layers of thin, flexible and tightly-woven ballistic fabrics that is generally lightweight and effective at stopping handgun rounds. In building up the layers, the resultant garment tends to be very stiff and restrictive of free movement. In normal use, soft armour generally protects against blunt trauma. Protective panels may be made from a slash-proof material that complies with at least British Standard (BS) EN 388-6.2 blade cut level 2.

To provide adequate protection against more serious threats, such as high velocity rifle rounds, soft-armour is augmented or otherwise substituted by the use of "hard armour". Hard armour can be considered to be equivalent to an exoskeleton in that it is fabricated from rigid plates made from ceramic, polymers or metal sheets. These plates are usually moulded or generally formed to conform to the physique of a standard wearer. Clearly, greater protection is achieved through the use of large plates of hard armour, although this has a drawback in that the plates are both relatively heavy and cumbersome and thus may become a risk to the wearer when submerged in water. Existing protective vest must therefore be load-bearing at the shoulders in order to position and hold the armour over designated areas of the torso.

It is advantageous to include flotation into a protective armour vest as users can be weighed down and pulled under the water. Regardless, the additional loading makes swimming difficult and the bulk of the inflatable jacket generally restrictive and uncomfortable. In U.S. Pat. No. 7,080,411 describes a protective body garment is provided including a vest having a body with arm holes, the vest having an internal surface and an external surface, and a front that, when worn, is adjacent to a wearer's chest and stomach, sides that, when worn, are adjacent to the wearer's sides, a back that, when worn, is adjacent to the wearer's back, and a pair of shoulders that, when worn, are above the wearer's shoulders. The garment further includes penetration resistant armour located under the external surface of the vest and an inflatable flotation bladder in the form of a bag between the inner surface of the vest and the penetration resistant armour. More specifically, the floatation bladder is constrained within a material pocket of the vest, with the armour within another material pocket formed within the vest outboard of the pocket for the floatation bladder.

The foregoing buoyancy problem associated with the weight of the armour and, indeed, the amount of heavy equipment (such as weapons) necessarily carried by military person means increased levels of buoyancy in an inflatable bladder are preferable. Increased buoyancy (from nominally 175 Newtons (N) to about 275N) can be achieved with increased bladder volume and increased internal pressures. Unfortunately, increasing the inflated volume of the bladder further restricts movement in existing designs, especially around the upper arms and neck region of the protective vest where bladder inflation is less constrained and the bladder (even if shaped) has a tendency to expand into any open space. Additionally, higher pressures within the bladder also generally restrict movement and these higher pressures must be overcome to facilitate arm and neck movement. Restricted movement, and resultant increased discomfort, are undesirable at times when a bladder is deployed within the constricting environment of a protective vest, particularly since the wearer will invariably be under considerable physical duress and/or stress in a hostile environment in which munitions are being targeted towards their general vicinity.

Given that a soldier, for example, might be a target who is being shot at directly, jettisoning the protective vest once the bladder is inflated is therefore not a realistic option, since body protection of the wearer would be entirely compromised. Conversely, having an over-sized protective vest that can always accommodate an inflated bladder is also not viable since the protective vest either (a) would not fit in which case the additional bagginess in the protective vest would likely impair movement or present a snagging risk, and/or (b) the over-sized nature of the protective vest would allow the relative position of the armour relative to the wearer's organs to change and thereby compromise the effectiveness of the armour. Designing a protective vest that is too big is therefore also not considered a sensible option since the bladder is, for the most part, always stored in a deflated state.

SUMMARY OF THE INVENTION

According to a first aspect of the present invention there is provided a protective vest having a body with arm holes defined between shoulder regions and a waist region of the protective vest, the protective vest comprising: a front portion made from a fabric material having an outer surface and an inner lining surface, the front portion having a left side and a right side; a rear portion made from a fabric material having an outer surface and an inner lining surface, the rear portion having a first side and a second side and wherein the rear portion is coupled to the front portion at the shoulder regions and wherein the left side and the right side are connectable to the first side and the second side to define the waist region of the protective vest; a length adjustable waistband having first and second ends, the first end securely coupled to the first side of the rear portion and the second end securely coupled to the second side of the rear portion, the waistband further including a primary snap-lock release buckle assembly having a male component and a female component into which the male component selectively positively but releasably engages, wherein the primary snap-lock release buckle assembly foreshortens the length of the length adjustable waistband when the male component is positively secured into the female component; a release cable having a local end and a remote end, the local end terminated in the male component and the remote end of the release cable connected to a floatation bladder, wherein the release cable is arranged such that, when tensioned, the male component disengages from the female component to allow the male component to be withdrawn and separated from the female component to cause extension of the length of the length adjustable waistband; a floatation bladder coupled to at least one of the inner lining surfaces; and wherein the release cable coupled between the rear portion of the vest and the male component of the primary snap-lock release buckle assembly is increasingly brought under tension upon inflation of the floatation bladder such that the male component disengages with inflation of the floatation bladder to increase automatically the length of the length adjustable waistband and to cause separation of the front portion from the rear portion about the waist region.

Preferably, the floatation bladder is selectively detachable from an inner lining of the protective vest (such as through use of Velcro® pads, lacing or the like).

In a preferred embodiment, the protective vest further comprises: at each shoulder region, a load bearing snap-lock release buckle assembly having a male component and a female component into which the male component selectively positively but releasably engages, wherein the male component is attached to one of the front portion or the back portion of the vest and the female portion is attached to the complementary other one of the back portion or the front portion of the vest such that each load bearing snap-lock release buckle assembly is arranged initially to foreshorten a connecting bridge between the front portion and the back portion at the shoulder regions, and each load bearing snap-lock release buckle assembly includes a release cable having a local end and a remote end, the local end terminated in the male component and the remote end connected to the length adjustable waistband, wherein the release cable is arranged such that, when tensioned following lengthening of the waistband with inflation of the floatation bladder, the male component automatically disengages from the female component to allow the male component to be withdrawn and separated from the female component to cause extension of the connecting bridge.

The connecting bridge may include a fold of material that permanently attaches the front portion of the vest to the back portion of the vest at each shoulder region and wherein the fold of material is arranged to be taken up to remove slack in the fold of material upon disengagement of the male component from the female component of the load-bearing snap-lock buckle to realize a lengthened load-bearing material connection across the shoulder regions that enlarges the internal volume of the protective vest to accommodate the inflated floatation bladder.

In another aspect of the present invention there is provided a protective vest having a body with arm holes defined between shoulder regions and a waist region of the protective vest, the protective vest comprising: a front portion made from a fabric material having an outer surface and an inner lining surface, the front portion having a left side and a right side; a rear portion made from a fabric material having an outer surface and an inner lining surface, the rear portion having a first side and a second side and wherein the rear portion is coupled to the front portion at the shoulder regions and wherein the left side and the right side are connectable to the first side and the second side to define the waist region of the protective vest; a length adjustable waistband having first and second ends, the first end securely coupled to the first side of the rear portion and the second end securely coupled to the second side of the rear portion, the waistband further including at least a first snap-lock release buckle assembly having a male component and a female component into which the male component selectively positively but releasably engages, wherein said at least a first snap-lock release buckle assembly foreshortens the length of the length adjustable waistband when the male component is positively secured into the female component; a first release cable having a local end and a remote end, the local end terminated in the male component of said at least a first snap-lock release buckle and the remote end of the first release cable connected to a floatation bladder via a central single-point actuator, wherein the central single-point actuator and first release cable are arranged to cooperate such that, when tension is introduced into the first release cable, the male component disengages from the female component to allow the male component to be withdrawn and separated from the female component to cause extension of the length of the adjustable waistband; a floatation bladder coupled to at least one of the inner lining surfaces; at each shoulder region, a load bearing snap-lock release buckle assembly having a male component and a female component into which the male component selectively positively but releasably engages, wherein the male component is attached to one of the front portion or the back portion of the vest and the female portion is attached to the complementary other one of the back portion or the front portion of the vest such that each load bearing snap-lock release buckle assembly is arranged initially to foreshorten a connecting bridge between the front portion and the back portion at the shoulder regions, and each load bearing snap-lock release buckle assembly includes a release cable having a local end and a remote end, the local end terminated in the male component of the load bearing snap-lock release buckle and the remote end connected to the rear portion of the protective vest through the central single-point actuator, wherein the release cables to the load bearing snap-lock release buckles are arranged such that, when tensioned following inflation of the floatation bladder, the male components automatically disengage from their respective female components to allow the male components to be withdrawn and separated from the female components to cause extension of connecting bridges and to cause substantially simultaneous separation of the front portion from the rear portion about both the waist region and shoulder regions of the protective vest.

The release mechanism for the waist and/or waistband advantageously ensures a reliable, smooth and automated enlargement of the internal volume in the protective vest at a point when the floatation bladder is inflated. The release mechanism obviates the need for the wearer of the protective vest to concern themselves with obtaining comfort and greater movement within the vest through manual release and adjustment of the volume of the vest at a time of high stress and/or danger.

Beneficially, an embodiment of the present invention provides a load-bearing but automatically releasable connection at each shoulder of the protective vest that carries and positions body armour displaced relative to the shoulders. Each load-bearing connection is automatically broken by inflation of the inflation bladder, whereby an excess fold of material in the shoulder-region of the protective vest is released to enlarge the sizing of the protective vest. The excess fold of material, once released, becomes load-bearing, with the now enlarged protective vest better accommodating the inflated bladder to provide improved freedom of movement within the protective vest. In other words, in the deflated state, as opposed to material in the shoulders of the protective vest, the connection at each shoulder is the principle load-bearing bridge or path between front and back portions of the protective vest.

The embodiments furthermore provide for both an instantaneous or staged automatic expansion of the volume of the protective vest.

The protective body armour vest is advantageously designed to permit, through a choice of configuration, the inflatable floatation bladder to be fitted within the protective vest or otherwise removed. Typically, the inflatable floatation bladder is removably attached to the body side of the garment lining.

BRIEF DESCRIPTION OF THE DRAWINGS

Exemplary embodiments of the invention will now be described by way of example with reference to the accompanying drawings in which.

DETAILED DESCRIPTION OF A PREFERRED EMBODIMENT

Figure 1:
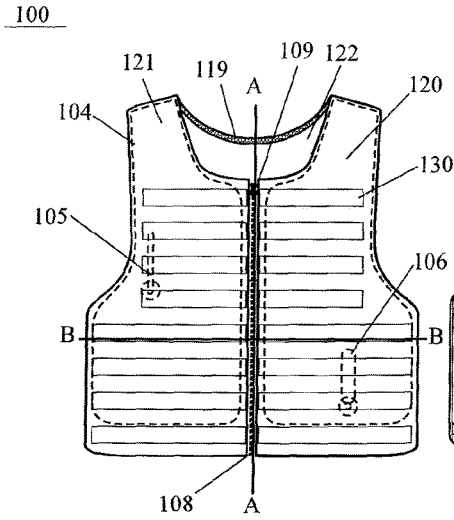
FIG. 1 is a front elevation of a body armour protective vest.

In FIG. 1, an armour vest 100 is configured to cover the torso of a user to protect generally at least some of the five vital organs, namely the heart, lungs, kidneys, liver and pancreas. The armour may cover other areas, as desired.

The vest may have a low profile to enable it to be worn under suitable outer clothing and thus as a concealed garment.

Figure 5:
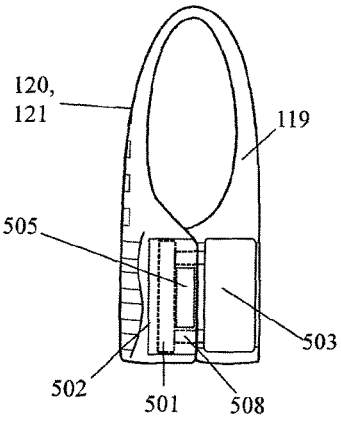
FIG. 5 is a side elevation of the body armour protective vest of FIG. 1, showing quick-release side tabs during normal use.

The armour vest 100 includes a detachable floatation bladder 104 providing, when deployed and inflated, buoyancy to the armour vest 100 and its wearer. The armour vest, in terms of its general construction, includes front left and right portions 120, 121 that attach to a back portion 119 at the shoulders, with a front opening 108 running from a neck opening to the bottom of the armour vest closed conventionally by a zipper 109. The front portions 120, 121 in combination with back portion 119 define a conventional sleeveless vest, with the front and back portions suitably sculpted. To provide an envelope and complete the vest, at least one of the back portion 119 and each front portion 120, 121 are shaped to form sides of the vest beneath arm openings defined by the sides and connection at the shoulders. The front and back portions are therefore attached along their side edges, such as through the use buckles or Velcro fasteners, and moreover typically overlap with one another along lateral edges, as can be seen in FIG. 5.

It will be appreciated that the armour vest can vary in shape and form depending both on end user requirements and intended application.

Pockets within body substrate of the armour vest 100 includes armour (which may be hard armour plate and/or soft armour inserts).

Figure 4:
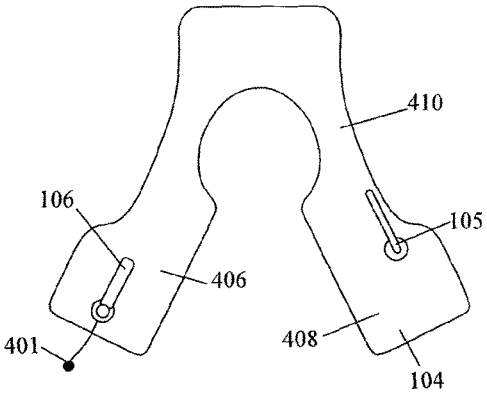
FIG. 4 is an illustration of an inflatable bladder.

FIG. 1 further shows dotted lines to identify the position of a mouthpiece 105 permitting oral inflation of the floatation bladder 104, as well as a gas bottle and gas-powered inflator (such as a gas bottle containing compressed gas released via a valve) 106 for automated inflation of the floatation bladder 104. The floatation bladder 104, shown in more detail in the lay-flat representation of FIG. 4, therefore comprises left and right front lobes 406, 408 connected by a back and neck chamber 410. The floatation bladder may be a unitary chamber or individual linked chambers typically connected by valves. Automated inflation can be brought about from sensed deployment in water, as will be understood, or upon use of a pull activator tab 401 connected to the gas bottle's release valve.

Figure 3:
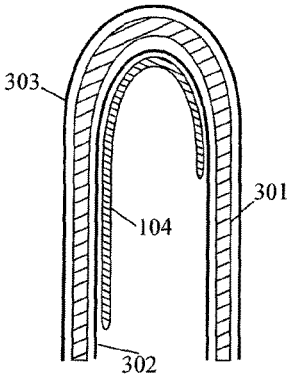
FIG. 3 is a cross section of the vest along line A-A of FIG. 1.

FIG. 3 shows a cross section of the armour vest 100 along line AA (of FIG. 1). An outer cover 303 of the vest is made from a rugged fabric, such as Nylon Cordura®, that may include a camouflage pattern. An outer surface of the outer cover may include MOLLE or other load carriage systems 130. Soft armour pack 301 comprise layers of ballistic material, such as UHMWPE (for instance Dyneema®) or Aramid fibre (for instance Kevlar®). The armour vest 100 can be lined with a liner 302 of mesh fabric to help lower thermal burden placed on the user of the vest. Armour is therefore located between the outer cover 303 and the inner liner 302. The inflatable floatation bladder 104 can be removably attached to the inner liner 302 of the vest by means of laces (not shown) or Velcro® or similar attachment mechanisms readily appreciated by the skilled addressee.

Figure 2:
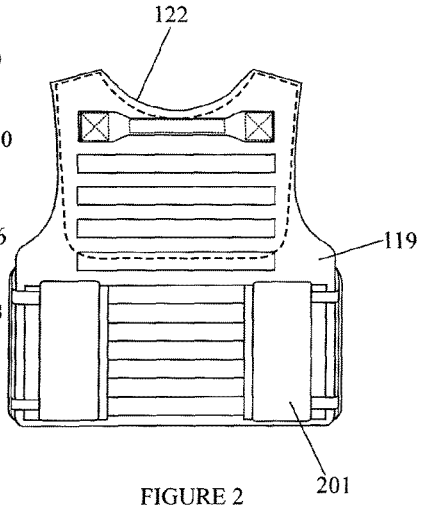
FIG. 2 is a back elevation of the body armour protective vest of FIG. 1.

FIG. 5 shows a side elevation of the armour vest (of FIGS. 1 and 2) in normal use and, particularly, it shows a releasable side tab in situ within casing 502. The releasable tab is made up of a platform 503 and stopper 501 which are connected together by a tether 508 such as webbing or similar. Velcro® 505, or other methods known in the art, is used to retain the stopper 501 within the casing 502 in normal use. Platform 503 provides a means of adjustable attachment of the front portions 120, 121 and back portion 119 through the use of Velcro, clips or similar methods to provide better varying levels of wearer fit.

Figure 6:
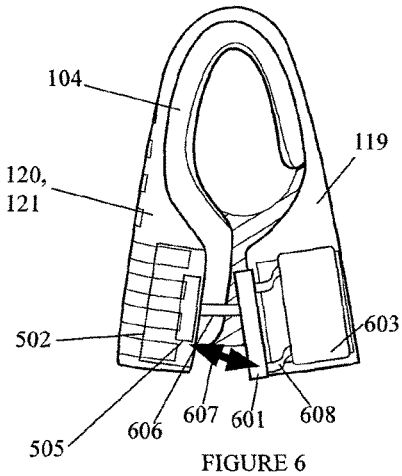
FIG. 6 is a side elevation of the body armour protective vest of FIG. 1, showing quick-release side tabs released following inflation of an internal inflatable bladder (such as shown in FIG. 4)

FIG. 6 shows a side elevation of the armour vest 100 with the floatation bladder 104 inflated and the vest expanded at the side overlap. The stopper 501 is released from the casing 502 with the pressure generated by inflation of the floatation bladder 104. The arrow 607 demonstrates the direction of the vest expansion. A tether 606 is used to contain, i.e. limit, the expansion of the vest once the floatation bladder 104 is inflated.

Figure 7:
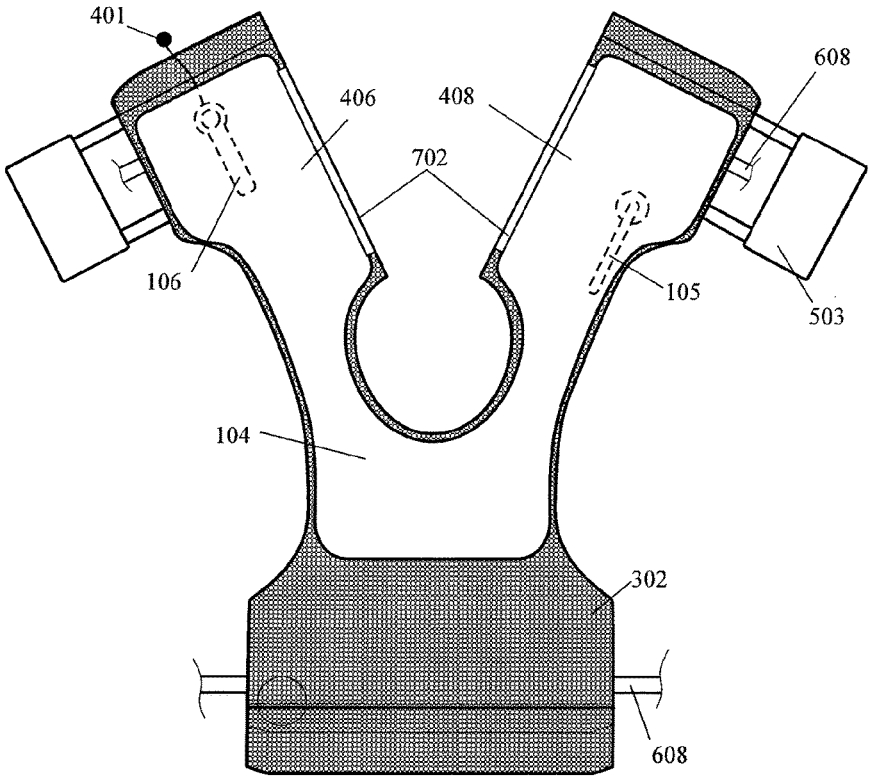
FIG. 7 shows a lay-flat drawing of the inflatable floatation bladder positioned within the body armour protective vest of FIG. 1.

FIG. 7 shows the internal view on an assembled armour vest, including the floatation bladder 104. Attachment means, such as shown at 702, connects and positions the floatation bladder on the vest lining 302 juxtaposed the wearer's body.

Figure 8:
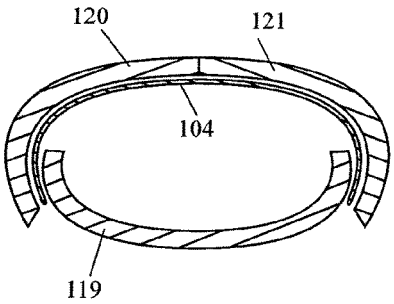
FIG. 8. is a cross sectional view of the body armour protective vest illustrating the position, in deflated state, of the inflatable floatation bladder in relation to the front and rear portions of the vest.
Figure 9:
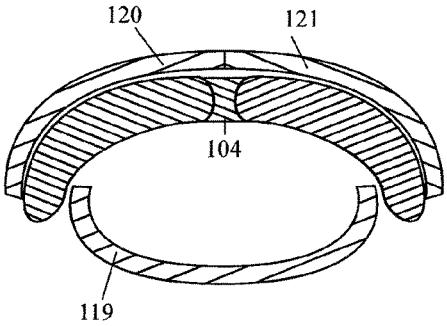
FIG. 9. is a cross sectional view of the body armour protective vest illustrating the position, in an inflated state, of the inflatable floatation bladder in relation to the front and rear portions of the vest.

FIGS. 8 and 9 are cross-sectional views along line B-B of the armour vest 100 of FIG. 1. FIG. 8 illustrates the floatation bladder 104 in a deflated pre-deployed state in relation to the front portions 120, 121 and back portion 119 of the armour vest 100. FIG. 9 shows the floatation bladder 104 inflated and the separation of the front portions 120, 121 from the back portion 119.

To this effect, the armour vest 104 is configured to expand at its sides upon inflation of the floatation bladder, with the floatation bladder removable attached to the inner liner 302 of the armour vest 104.

Turning now to the preferred embodiments of FIGS. 10 to 22 and also FIGS. 23 to 27.

Figure 12:
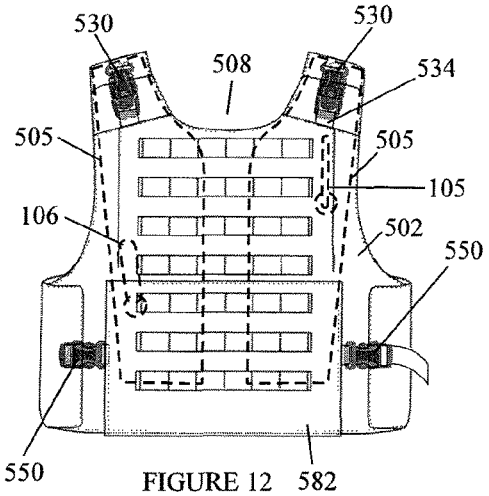
FIGS. 12 and 13 are front and rear view of the armour vest of FIG. 10, including outline positioning of a floatation bladder.
Figure 13:
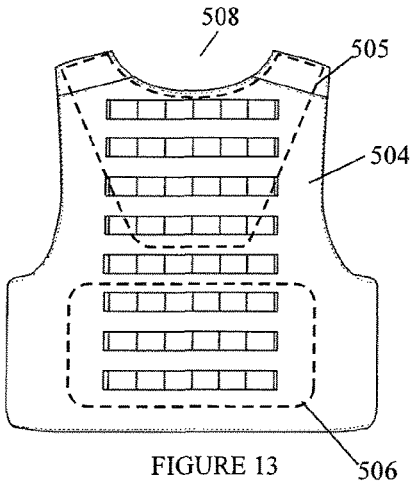

FIGS. 10 to 13 are front and side views of an armour vest 500 according to a preferred embodiment of the present invention, with FIGS. 12 and 13 showing additional positioning of an underlying floatation bladder 505 (shown in dotted outline and in a deflated state). In a similar fashion to the general shape of FIG. 1, FIGS. 10 and 11 have at least a front portion 502 and a rear portion 504. The front and rear portions therefore define a vest having a neck opening 508 and arm opening 510 between vest shoulders 512 and a waist region 514 of the armour vest. The waist region 514 is produced by an overlap between the front and rear portions at a point below the arm openings 510.

The front portion 502 may, in fact, be constructed from a front left portion and a front right portion secured together by a zipper or the like (shown only in FIG. 1), with the zipper facilitating donning of the armour vest 500. The front and rear portions will, typically within internal pocket or within a lining of the vest, support and position armour plate that may be fixed or removable. For the sake of clarity and representation purposes, only a single armour plate 506 (or soft armour pad) is shown in FIG. 13.

The flotation bladder 505 is attached to an inner lining of the armour vest, such as shown in FIG. 3. Attachment of the lining may be permanent or temporary, such as through the use of lacing, hook and loop fastening or equivalent attachment techniques readily understood by the skilled address.

The front portion 502 and the rear portion 504 of the armour vest are coupled together primarily at the shoulders 512, but typically also at the sides of the vest 500 to define the waist region 514. The regions at the shoulders 512 are therefore load-bearing connections from which the weight of the armour plate (or soft armour) and indeed the general weight of the vest (and any attached equipment) is hung.

The front portion and the back portion are always attached to each other through a loading-bearing connection, although this load-bearing connection physically changes.

In a first instance in which the floatation bladder is fixed in situ within the armour vest 500 but present in a deflated state, the front portion 502 (or portions) is/are coupled to the rear portion 504 primarily by a selectably releasable shoulder connection 530, preferably in the form of a quick-release snap-lock buckle assembly. Other selectably releasable connections can be considered, such as a lateral burstable zip; these will be considered and explained below.

Figure 14A:
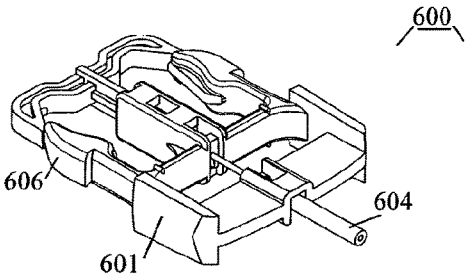
FIGS. 14*a* and 14*b* show a snap-fit clasp, including detail of a male side including a release mechanism and an in situ view of the male side engaged into a female housing that forms a remotely releasable connection.
Figure 14B:
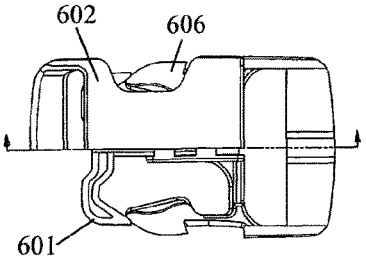

From the preferred perspective of a quick-release snap-lock buckle assembly 600, reference is made briefly made to FIGS. 14*a* and 14*b* that show a male component 601 and female component 602 into which the male component is positively engaged. The quick release snap-lock buckle assembly is described in more detail in U.S. Pat. No. 8,196,273-Anscher. The male component 601 is inserted into the female component 602 to lock the buckle assembly together. The male buckle component is connected to a cable 604. Pulling the cable 604 with sufficient force causes the male component to pull in its engaging arms 606 to release their engagement from a locking detent 608 in the female component 602. In the cable is not sufficiently tensioned/pulled to draw in the arms of the male component, then those arms positively engage into the locking detent, such as shoulders, formed in the female component 602.

Returning to FIGS. 10 to 13, one of the female and male components of the quick-release snap-lock buckle assembly 600 is strongly attached in the shoulder regions of either the front or rear portions of the armour vest, with the complementary male or female component strongly attached in the shoulder regions to the other one of either the rear or front portions of the armour vest. Webbing 534 and stitching is typically used to anchor each male and female component to an outer material surface 536 of the armour vest. Once these complementary components of the quick-release snap lock are engaged with each other, the snap-lock buckle assembly 600 defines the load-bearing connection between the front and rear.

Padding may be provided beneath each shoulder buckle to cushion the quick-release snap-lock buckle assembly 600 against the wearer's shoulders. Padding may simply be applied to the buckle or be realized by the deflated floatation bladder 505, or may preferably take the form of a fold of material extending between the front and rear portions 502, 504 to define a shoulder bridge 511. Excess material used to produce the fold is attached permanently to both the front and rear portions 502, 504 and may be integrally formed as an over-the-top extension from either the front or rear portions of the body armour. The shoulder bridge, in a first instance, is not a dominant load bearing connection with a majority of the weight of the armour in the armour vest being passed through the quick-release snap-lock buckle assemblies 600 at each of the wearer's shoulders.

The load-bearing nature of the shoulder regions means that the connection between the front and rear portions cannot be elastic in nature (to any appreciable, if any, extent) and cannot be unintentionally extended, i.e. lengthened, to any noticeably extent through shear separation arising from gravity effects on either side of a fulcrum realized by the wearer's shoulders. More specifically, the load-bearing connection of the shoulder connection between the front portion 502 and rear portion 504 is realised by engagement of the quick-release snap-lock buckle assembly 600.

An alternative to the preferred snap-lock assembly is the use of a laterally extending breakable/burstable zip running substantially near or along the tops of each shoulder, although it is noted that resilience of the zip and load-bearing capabilities may be limited by the relatively short length of the zip. A further alternative is the use of strong Velcro®, although it is observed that separation of the hooks and loops of Velcro® tabs would need to peel the connection since shearing of Velcro® is difficult, but not impossible. The common function is that the shoulder connection—in the deflated state of the floatation bladder—is a selectively breakable expandable joint. The use of a burstable zip or Velcro® straps is believed to represent an inferior configurations for the loading bearing shoulder connection since instances may arise in which the initial front-to-back coupling (provided by the zip and/or Velcro®) is inadvertently, i.e. accidentally, broken through a heavy loading of the connection with weight and/or movement of the wearer (on dry land). The snap-lock assembly, in contrast, requires a positive release action to disengage the male and female parts, which positive release action means that in normal use bladder inflation is unlikely to inadvertently occur and the releasable buckle provides a tensioned force path that is designed to carry—with an excess load tolerance—the weight of the vest (including armour and ancillary equipment attached to, for example, Molle) when the vest is worn and extensively loaded. The buckle therefore obviates the likelihood of shoulder separation.

Figure 10:
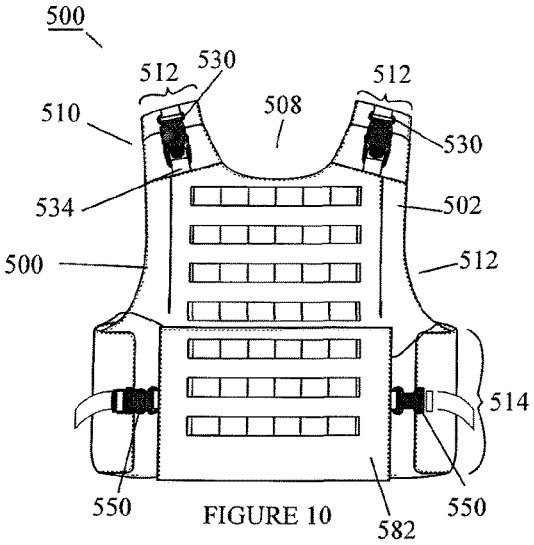
FIGS. 10 and 11 are front a side views of an armour vest according to a preferred embodiment of the present invention.
Figure 11:
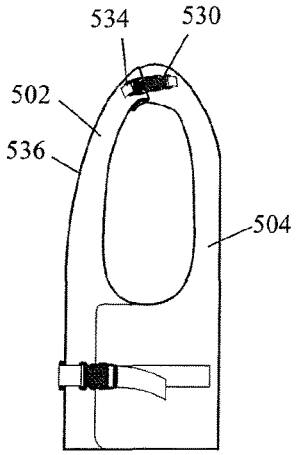

To form the armour vest as a close-fitting garment and to define a first size (and, indeed, a first volume) for the armour vest, FIGS. 10 and 13 shows side-adjustable connectors 550 positioned proximate to the waist of the vest and functionally connecting the front portion and rear portion at the sides beneath the arm openings. The position of at least one side of the side adjustable connector relative to a piece of fixed webbing can be changed, e.g. shortened by altering an end loop 570 as will be understood, to adjust the waist of the armour vest 500. The side adjustable connector 550, in a first embodiment, may be a conventional buckle, such as the Single Bar Power Pro® Tensionlock® Buckle by Tri-Point Hardware, Inc. Other adjustable connectors can be used.

Figure 15:
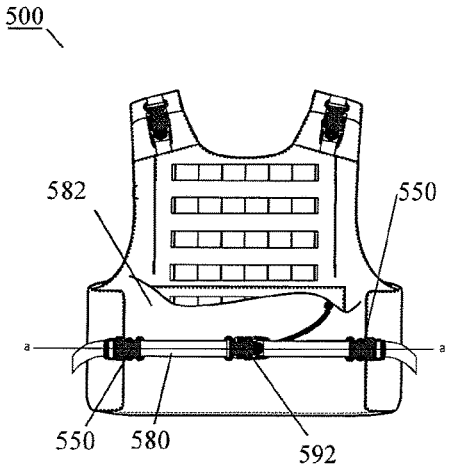
FIG. 15 shows the armour vest of FIG. 10 having a front flap lifted to expose an expansion mechanism of a preferred embodiment.
Figure 16:
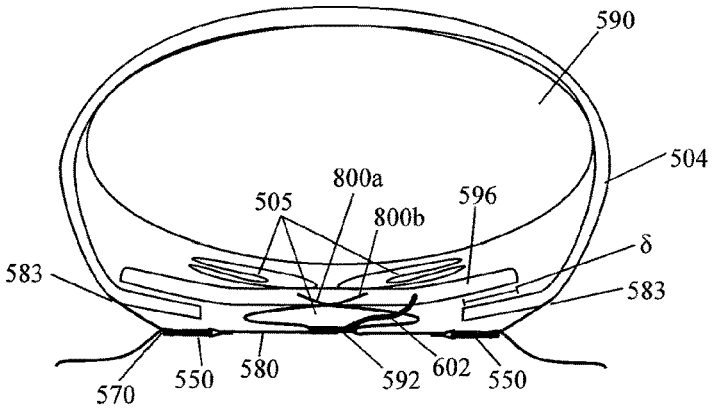
FIGS. 16 and 17 show section views through the armour vest of FIG. 10 with the floatation bladder either deflated (FIG. 16) or inflated (FIG. 17)
Figure 17:
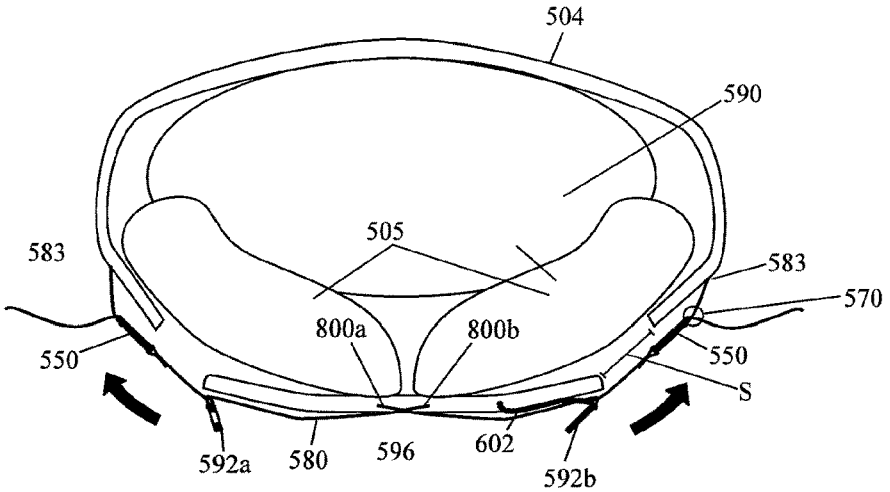

Turning to FIGS. 15 to 17, a more detailed representation of an adjustable waistband 580 employed under a protective material flap 582 of the armour vest of FIG. 10 is shown. The flap 582 is optional, but preferable. The waistband 580 is essentially strong webbing material that is attached (and preferably fixedly anchored) at both its remote ends 583 to wrap-around sides, typically, of the rear portion 504 of the armour vest, thereby allowing adjustment of the waistband from the front of the armour vest. Of course, the anchor point may be reversed and on the front portion 502 of the armour vest. The webbing includes at least one adjustable side connector 550 and preferably a pair of side connectors 550; one for the left side and one for the right side of the armour vest. Assuming a pair of side connectors merely for symmetry and relative ease of explanation, a primary release buckle 592 (such as described above, shown in FIGS. 14*a* and 14*b* and described in U.S. Pat. No. 8,196,273-Anscher) is inboard of the side connectors and foreshortens the length of the webbing waistband 580, thereby producing some slack in the webbing when the floatation bladder 505 is deflated; this is shown in FIG. 16. The region of slack is therefore packed or folded in a primed state, with the slack taken up when the floatation bladder 505 is deployed and the primary release buckle 592 disengaged, i.e. released. The side adjustable connectors 550 may also be realized by a conventional three-pong releasable buckle, such as a Rock Lockster® side release buckle, to facilitate donning/access of the armour vest 500.

The foreshortening allows the waistband to produce a comfortable but relatively tight fit around the wearer's waist. With the floatation bladder deflated and packed in place behind protective armour 506 (either plate or soft armour), the armour vest is therefore relatively tightly fitting as is needed with conventional protective vests, but comfortable and neither overly loose nor overly restrictive. The combination of the engaged quick-release snap-lock buckle assemblies at the shoulders 600, the side adjustable connectors and the engagement of the primary release buckle defines a first volume for the armour vest that is marginally larger than the volume of the chest 590 of the wearer. In FIG. 16, it should be noted that there is a pronounced overlap, δ, at the sides between the rear portion 504 and front portions of the body armour. FIG. 6 also shows the relative positioning of the floatation bladder to the armour, i.e. the floatation bladder is packed below soft armour 596 or armour plate in the front portion of the armour vest and thus FIG. 16 reflects the section view shown in FIGS. 3, 8 and 9.

With the male and female counterparts of the primary release buckle 592 engaged with one another, the buckle permits the vest to be roughly pulled without the vest expanding in volume. Rough treatment therefore permits the wearer to be dragged, for example, away from danger (on dry land) without the floatation bladder or the vest being expanded or caused to expand. Volume of the vest only increases with a positive action that positively causes disengagement of the buckle through tensioning of the cable 602. This cable-buckle release mechanism contrasts with Velcro® that can be inadvertently peeled or sheared, with such inadvertent separation compromising protection of the wearer.

Once the primary release buckle 592 is disengaged by separating the female part 592*a* from the male counterpart 592*b*, the waistband is lengthened by taking up any slack in the webbing and thus acquiring the overall length of the webbing. Similarly, once the load-bearing shoulder buckles are disengaged, the front and rear portions of the armour (at the shoulders) can increase their separation, although this increase may be constrained by the amount of material (for example) in the fold of material that then forms the connecting bridge. The volume of the armour vest is therefore determined and defined by these buckle connections and the volume is selectable changeable. For example, when the floatation bladder is inflated and internally deployed within the armour vest, the volume of the armour vest increases since the overlap of the rear and front portions 502, 504 is at least reduced if not destroyed to produce a separation, s (as shown in FIG. 17). An alternative means of increasing the volume may be a breakable zip, which under pressure of the inflating bladder bursts open and releases the slack.

Figure 18:
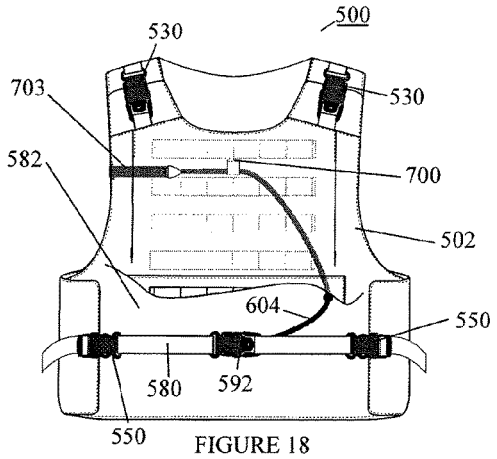
FIGS. 18 to 20 show a preferred primary release mechanism primed to initiate multi-stage expansion of the armour vest of FIG. 10.
Figure 19:
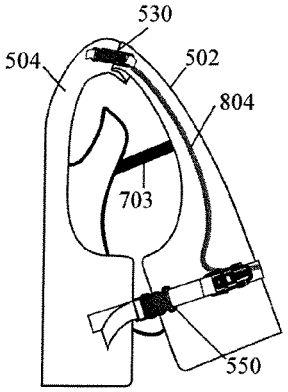
Figure 20:
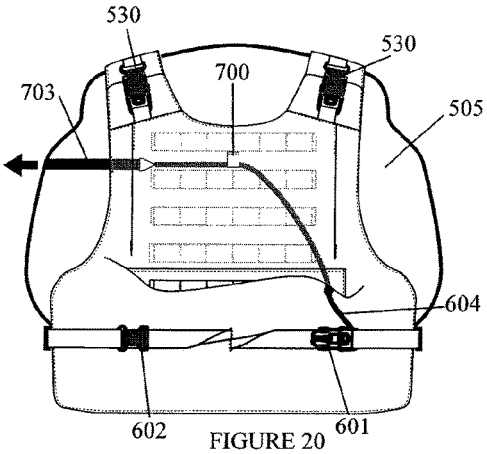

The primary release buckle 592 includes a release cable 604 that is, typically, fed through a protective sleeve that is routed through and under (as much as possible) a fabric covering of the armour vest. Preferably, a path of the release cable 604 beneath the fabric is defined by one or more strategically located cable retainers 700, such as fabric loops, that deliver the pull force in an optimal orientation with respect to the primary release buckle 592. The release cable 604, as shown in FIG. 14*a*, is anchored at one end into the male component of the primary release buckle 592 such that pulling on the release cable—when the male component 601 is fixedly held by the female component and the female component is held relatively stationary through anchoring—causes disengaging of the male component from the female component and thus release of the primary buckle 592. FIG. 18 furthermore shows the material flap 582 lifted or open and the release cable 602 coupled at its second end to a webbing strip 703. Connection of the cable to the webbing strip 703 may make use of a simple loop at the end of the webbing strip. A distal (remote) end of the webbing strip 701, in turn, is fixedly anchored to either the floatation bladder or the armour vest, but preferably the floatation bladder. More specifically, the webbing strip 703 extends across, i.e. bridges, a side gap between the front and rear portions of the armour vest. Webbing strip 703 is optional but preferred, since direct connection of the distal end of the cable is considered more difficult to implement and the wider and softer nature of webbing is considered less likely to cut into fabric and/or the floatation bladder once it's inflated.

In terms of activation, actuation of the floatation bladder inflation mechanism beneficially causes the volume of the armour vest to increase upon deployment/inflation of the floatation bladder (either automatically upon contact with water or following a manual event, such as pulling on a release chord 401 to open the valve on the gas bottle 106 to release gas into the floatation bladder 505).

More specifically, as shown in FIGS. 19 to 22, deployment and inflation of the floatation bladder 505 extends the side gap between the front and rear portions of the armour vest. The floatation bladder 505 expands in volume and thus separates the front and rear portions of the armour vest. This relative expansion is shown by contrasting FIGS. 16 and 17 and noting the reduction of the overlap δ and the presence of a separation, s. With the increase in side separation, the webbing strip 703 is pulled across the expanded side gaps and therefore effectively away its anchor point on the waistband 580, which relative movement consequently tensions the release cable 604 to generates sufficient tensioning force to bring about disengagement of the male and female components in the primary release buckle 592. The waist of the armour vest now expands to take up the slack in the waistband 580. This is represents phase one in the change in shape and volume of the armour vest. The webbing strap can also be considered as a manual actuation handle since it can be pulled manually, rather than pulled relative to the front portion of the armour vest by bladder expansion.

Figure 21:
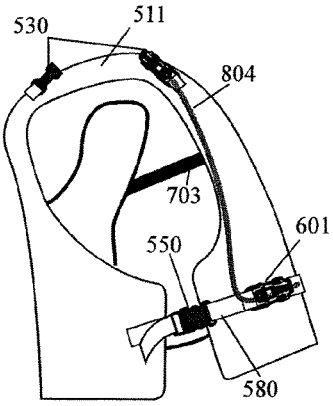
FIGS. 21 and 22 show a preferred secondary release mechanism for expanding the armour vest of FIG. 10, the prior load-bearing shoulder connections now in a triggered position.
Figure 22:
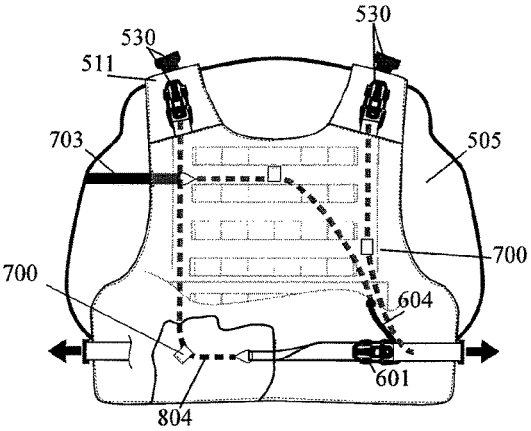

With particular reference to FIGS. 16, 17, 21 and 22, at least additional webbing strap 800*a*, 800*b* are anchored either to the webbing of the waistband or to the fabric cover. This additional webbing strap 800*a* is further coupled to secondary release cables 804 that are channelled, as necessary, through cable guides 700 for attachment to each releasable shoulder connection 530. A pair of secondary release cables can be run—one each—from a pair of webbing straps, with each secondary release cable serving each releasable shoulder connection 530. Alternatively, a single webbing strap may act to attach a pair of secondary release cables 800*a*, 800*b*. Consequently, one the primary release buckle 592 separates, tension is introduced into the secondary release cables to the effect that the each releasable shoulder connections 530 (for the left and rights shoulders) release to permit—in a second phase—further change in the shape and expansion of the volume of the armour vest at the shoulders. This additional expansion provides for better accommodation of the now inflated floatation bladder 505 within the armour vest; this is shown in FIGS. 21 and 22 especially where male and female components of the primary release buckle 592 and the releasable shoulder connections 530 are shown disengaged from one another. The secondary release cables are therefore only under tension at the point after the primary release buckle has been released.

There are two practical configurations for the waistband 580. In both instances, ends of the waistband are respectively anchored to the rear portion of the vest at respective sides beneath the arm holes and typically close to the bottom on the vest; this is shown particularly well in FIGS. 19 and 21 relative to the right arm of the vest. Anchoring of the waistband in this fashion allows for definition of the waist and arm holes of the vest. [The waistband 580, as previously indicated, includes a primary release buckle 601, 602 that acts to foreshorten the webbing used in the waistband. The waistband can also include conventional shortening loops to permit close fitting adjustment and alteration of the length of the waistband.] The waistband may also be preferably anchored to the front portion of the vest, with the primary release buckle assembly, when assembled—such that the male component is positively engaged into the female component—foreshortening the waistband's overall length but building in loop of webbing whose slack is taken up when the male component is disengaged from the female component (under tensioning of the release cable 604). In the event that the waistband is not anchored to the front portion of the vest, then the waistband 580 just encircles the front portion and the primary release buckle assembly again allowing foreshortening of the webbing length to keep the waistband relatively taught around the waist of the wearer (like a belt). Once disengaged, the primary release buckle assembly allows for webbing length expansion through the take up of the slack loop to permit enlargement of the vest's volume (at the point of floatation bladder inflation) by enlarging the waist. Having the waistband anchored to the front portion of the vest at at least one point is preferable since this intermediate and secondary anchoring provides a relative fixed position for the primary release buckle assembly and therefore an anchor against which the cable release mechanism can act.

The waist expansion aspect that makes use of the primary release buckle can be implemented independently of the secondary release mechanism that increases separation between the front and rear portions of the vest at the shoulders.

At the shoulders of the armour vest, the previous fold of material in the shoulder bridge 511 is now released and becomes load-bearing and so holds the front portion 502 and rear portion 504 of the armour vest together, but also maintains armour (either plate or soft armour) in position. In other words, the weight of the armour (at least) remains through the shoulders, although this weight now acts through the shoulder bridge 511 rather than the releasable shoulder connections 530. Release of the shoulder connections is the phase two expansion which follows initial controlled expansion of the waist. Both shoulder connections can be broken substantially at the same time, or one may be initially broken and its expansion (and the routing of the other secondary release cable) can then cause the other shoulder connection to be broken to expand.

Maintaining a physical material bridge at the shoulders (once the bladder is inflated) between the front and rear portions of the vest is beneficial because this material bridge acts to hold the armour in place and also maintains the overall shape of the vest. Maintaining a material shoulder connection also provides a degree of physical protection to the floatation bladder. The uptake of the excess fold of material in the shoulders (of the preferred embodiment) therefore constrains, to some extent, the floatation bladder's relative position with respect to the wearer's body.

It is noted, again, that the floatation bladder is not within the material of the armour vest, but rather a separate entity inboard of the armour vest, as shown in FIG. 3. The floatation bladder is therefore easy removable and can be easily repacked and re-charged for multiple use. The contrasts with prior art designs in which the bladder is sandwiched between layers of material that define the vest.

In an alternative embodiment, it has been recognized that the shoulder bridge 511 can, in fact, be realized not by an integral fold of material, but instead (or additionally) by the flotation bladder itself. More specifically, since it is preferred that the floatation bladder 505 is attached to both the front and rear portions of the armour vest, breaking of the shoulder connections 530 of the vest and inflation of the floatation bladder produces an active load-bearing connection between the front and rear portions at the shoulder regions of the floatation bladder. The shoulder regions of the floatation bladder and/or a material shoulder bridge 511 may be load bearing in the volume expanded armour vest of FIGS. 21 and 22.

The primary release buckle can, furthermore, optionally be released on a manual basis by pulling on the webbing 703, thereby tensioning the primary release cable 604 to trigger the multi-stage release of the various connectors.

Beneficially, the arrangement of FIGS. 10 to 22 means that the floatation bladder remains protected when both stored and protected to an appreciable extent when inflated. Further, expansion of the vest is driven in two stages and based on the natural volume expansion of the floatation bladder from its source of inflation. In essence, it will be understood that inflation occurs on a chamber-to-chamber basis, with expansion of the first chamber (typically around the waist) following by inflation of the neck region and finally the chamber farthermost from the gas bottle (or oral inflation tublet). It would, in principle, be possible to reverse the expansion to cause the shoulders to burst initially and then the waist, although the conventional mechanism is waist first because of conventional location of the gas bottle. The preferred protective garment with combined floatation bladder therefore retains vest shape, but its expanded form provides improved comfort and freedom to move. In fact, the present invention permits for larger floatation bladders with higher buoyancies to be provided and, indeed, potentially for a one-size jacket to accommodate all sizes of wearer and all carried equipment levels. The shoulder connection 530 are therefore non-expandable in a first instance when their releasable buckles are engaged and active to ensure that armour position remains fixed to optimize protection, and expanded in a second bladder deployed state which substantially maintains the armour's position. The extended length of the bridge that is established upon disengagement of the female and male components of the automatically releasable snap-lock buckles—such as shown in FIGS. 14*a* and 14*b*—acts to maintain the integrity of the protective vest and to support, i.e. bear the load of, integrated body armour when should the vest be subject to gravity (on dry land) rather than water uplift when floating. The maintenance of a connecting bridge therefore advantageously permits rougher physical handling of the protective vest whilst maintaining armour positioning.

Turning to FIGS. 23 to 27, an alternative embodiment of a protective vest with an integrated floatation bladder is shown. In this embodiment, waist adjustment is provided by side adjustors 900 realized by the quick release buckles shown in FIGS. 14*a* and 14*b*. These side adjustors permit waist-sizing through conventional adjustment of a webbing length 902. Again, load-bearing shoulders are initially realized by the quick release buckles of FIGS. 10 to 22. A further difference relative to the preferred embodiment is that FIGS. 23 to 27 does not make use of primary release buckle 592 in the waistband, but instead a centralized, single-point actuator 904 attached, i.e. anchored, to either the material covering of the armour vest or otherwise some part of the armour itself. Furthermore, the front and rear portions of the armour vest are preferably coupled together at the sides, juxtaposed the waistline or below the arm opening by a constraining webbing link 910.

Figure 23:
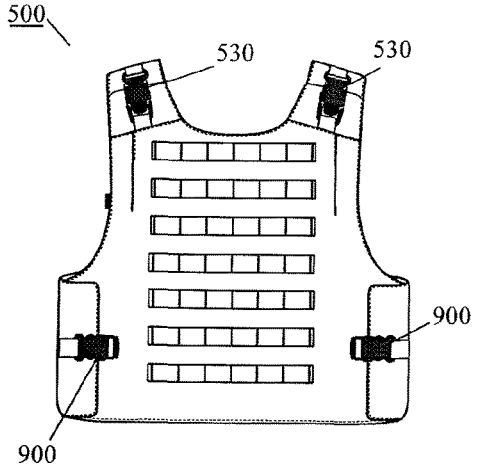
FIGS. 23 to 27 illustrate an alternative embodiment of the present invention, including a single stage release mechanism permitting controlled expansion of the volume of armour vest and floatation bladder combination.
Figure 24:
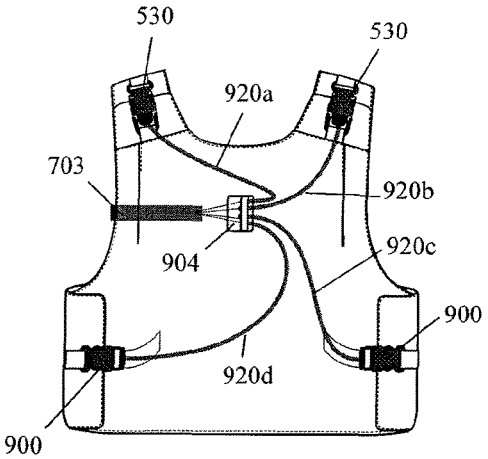
Figure 25:
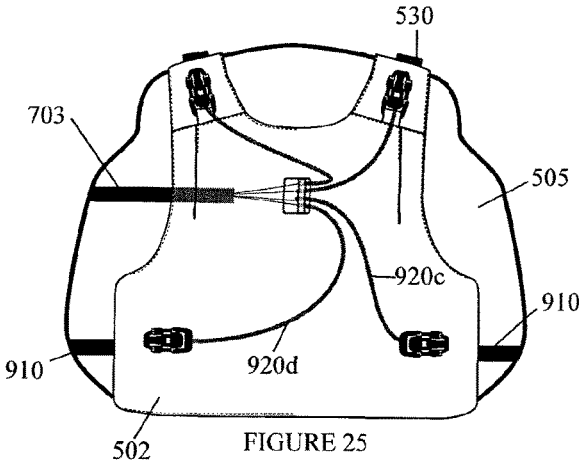
Figure 26:
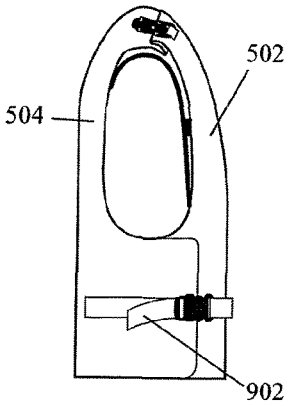
Figure 27:
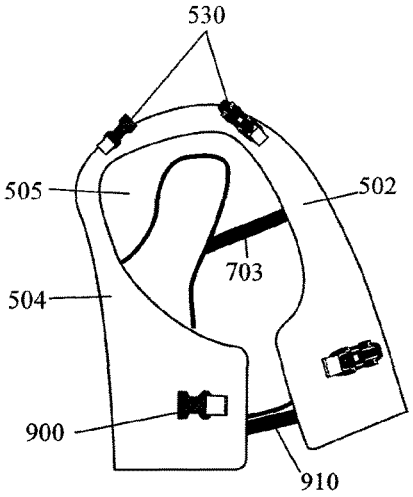

For vest enlargement, all release cables 920*a*-920*d* for the side and shoulder buckles—in this case preferably fours, as shown in FIG. 23—have remote ends coupled into the buckles and distal ends connected together at the centralized, single-point actutator assembly 904. The distal ends of the release cables are therefore all coupled to webbing 703 that, in a similar fashion to FIGS. 10 to 22, attaches to the floatation bladder 505 or otherwise the complementary portion of the armour vest, e.g. the rear portion of the centralized, single-point actutator 904 is fixed to the front portion.

In terms of vest size enlargement, pulling on the webbing strip 703—that acts as a release handle—tensions all the release cables and causes all connected buckle assemblies to be simultaneously released by disengaging the male components of the buckle from their female counterparts. Alternatively, sensed automated inflation (e.g. upon contact with water) of the floatation bladder 505 can similarly tension the release cables within and relative to the actuator assembly, as will be understood.

Release cabling will, again, typically be run through a protective sheath which is routed inside and outside of a material covering of the vest and through strategically located cable guides.

The alternative embodiment therefore provides a rapid, single-stage expansion of an armour vest to permit comfortable accommodation of a highly buoyant floatation that, typically, has a buoyancy of greater than about 175N and preferably greater than about 250N.

It will be further understood that unless features in the particular preferred embodiments are expressly identified as incompatible with one another or the surrounding context implies that they are mutually exclusive and not readily combinable in a complementary and/or supportive sense, the totality of this disclosure contemplates and envisions that specific features of those complementary embodiments can be selectively combined to provide one or more comprehensive, but slightly different, technical solutions.

It will, of course, be appreciated that the above description has been given by way of example only and that modifications in details may be made within the scope of the present invention. For example, the inflatable floatation bladder can be inflated manually by pulling on a lanyard attached to a gas bottle and inflator system as is well known in the art. The inflator system can be of the type that inflates automatically if the user is immersed. The bladders can also be fitted with means for oral inflation. The inflation bladder may be constructed from interconnected inflatable elements, namely right and left sides and a back portion.

Unless the context requires a more limited interpretation, the terms "armour plate" and "soft armour" are interchangeable and relate to a ballistic or slash-proof protective region of material that may be shaped to protect a specific body region on a wearer, but regardless is manufactured and designed to stop or limit penetration by a round of ammunition, a knife or blade or high velocity shrapnel incident on the protective region. Unless the context requires a more specific interpretation, the term "body armour" will is intended to cover both armour plate and soft armour covering a designated area or specific organ of the body.

The invention claimed is:

1. A protective vest having a body with arm holes defined between shoulder regions and a waist region of the protective vest, the protective vest comprising:

a front portion made from a fabric material having an outer surface and an inner lining surface, the front portion having a left side and a right side;

a rear portion made from a fabric material having an outer surface and an inner lining surface, the rear portion having a first side and a second side and wherein the rear portion is coupled to the front portion at the shoulder regions and wherein the left side and the right side are connectable to the first side and the second side to define the waist region of the protective vest;

a length adjustable waistband having first and second ends, the first end securely coupled to the first side of the rear portion and the second end securely coupled to the second side of the rear portion, the waistband further including a primary snap-lock release buckle assembly having a male component and a female component into which the male component selectively positively but releasably engages, wherein the primary snap-lock release buckle assembly foreshortens the length of the length adjustable waistband when the male component is positively secured into the female component;

a release cable having a local end and a remote end, the local end terminated in the male component and the remote end of the release cable connected to a floatation bladder, wherein the release cable is arranged such that, when tensioned, the male component disengages from the female component to allow the male component to be withdrawn and separated from the female component to cause extension of the length of the length adjustable waistband;

a floatation bladder coupled to at least one of the inner lining surfaces; and wherein the release cable coupled between the rear portion of the vest and the male component of the primary snap-lock release buckle assembly is increasingly brought under tension upon inflation of the floatation bladder such that the male component disengages with inflation of the floatation bladder to increase automatically the length of the length adjustable waistband and to cause separation of the front portion from the rear portion about the waist region.

2. The protective vest according to claim 1, wherein the release cable, over its length, is routed at least partially between the outer surface and an inner lining surface of the front portion of the vest.

3. The protective vest according to claim 1, wherein the waistband is further anchored to the front portion.

4. The protective vest according to claim 1, wherein the floatation bladder is selectively detachable from an inner lining of the protective vest.

5. The protective vest according to claim 1, wherein the protective vest includes body armour located between the outer surface and an inner lining surface of at least one of the front and rear portions of the protective vest.

6. The protective vest according to claim 1, further including at least one cable guide that defines a route for the release cable across the front portion of the vest.

7. The protective vest according to claim 1, wherein the remote end of the release cable is connected to the floatation bladder through a strap connected at a point above the waist and below the arm hole.

8. The protective vest according to claim 1, wherein the waistband further includes at least one length adjusting loop of material that permits initial fitting of the vest about a wearer's torso.

9. The protective vest according to claim 1, further comprising:

at each shoulder region, a load bearing snap-lock release buckle assembly having a male component and a female component into which the male component selectively positively but releasably engages, wherein the male component is attached to one of the front portion or the back portion of the vest and the female portion is attached to the complementary other one of the back portion or the front portion of the vest such that each load bearing snap-lock release buckle assembly is arranged initially to foreshorten a connecting bridge between the front portion and the back portion at the shoulder regions, and each load bearing snap-lock release buckle assembly includes a release cable having a local end and a remote end, the local end terminated in the male component and the remote end connected to the length adjustable waistband, wherein the release cable is arranged such that, when tensioned following lengthening of the waistband with inflation of the floatation bladder, the male component automatically disengages from the female component to allow the male component to be withdrawn and separated from the female component to cause extension of the connecting bridge.

10. The protective vest according to claim 9, wherein the connecting bridge includes a fold of material that permanently attaches the front portion of the vest to the back portion of the vest at each shoulder region and wherein the fold of material is arranged to be taken up to remove slack in the fold of material upon disengagement of the male component from the female component of the load-bearing snap-lock buckle to realize a lengthened load-bearing material connection across the shoulder regions that enlarges the internal volume of the protective vest to accommodate the inflated floatation bladder.

11. A protective vest having a body with arm holes defined between shoulder regions and a waist region of the protective vest, the protective vest comprising:

a front portion made from a fabric material having an outer surface and an inner lining surface, the front portion having a left side and a right side;

a rear portion made from a fabric material having an outer surface and an inner lining surface, the rear portion having a first side and a second side and wherein the rear portion is coupled to the front portion at the shoulder regions and wherein the left side and the right side are connectable to the first side and the second side to define the waist region of the protective vest;

a length adjustable waistband having first and second ends, the first end securely coupled to the first side of the rear portion and the second end securely coupled to the second side of the rear portion, the waistband further including at least a first snap-lock release buckle assembly having a male component and a female component into which the male component selectively positively but releasably engages, wherein said at least a first snap-lock release buckle assembly foreshortens the length of the length adjustable waistband when the male component is positively secured into the female component;

a first release cable having a local end and a remote end, the local end terminated in the male component of said at least a first snap-lock release buckle and the remote end of the first release cable connected to a floatation bladder via a central single-point actuator, wherein the central single-point actuator and first release cable are arranged to cooperate such that, when tension is introduced into the first release cable, the male component disengages from the female component to allow the male component to be withdrawn and separated from the female component to cause extension of the length of the adjustable waistband;

a floatation bladder coupled to at least one of the inner lining surfaces;

at each shoulder region, a load bearing snap-lock release buckle assembly having a male component and a female component into which the male component selectively positively but releasably engages, wherein the male component is attached to one of the front portion or the back portion of the vest and the female portion is attached to the complementary other one of the back portion or the front portion of the vest such that each load bearing snap-lock release buckle assembly is arranged initially to foreshorten a connecting bridge between the front portion and the back portion at the shoulder regions, and each load bearing snap-lock release buckle assembly includes a release cable having a local end and a remote end, the local end terminated in the male component of the load bearing snap-lock release buckle and the remote end connected to the rear portion of the protective vest through the central single-point actuator, wherein the release cables to the load bearing snap-lock release buckles are arranged such that, when tensioned following inflation of the floatation bladder, the male components automatically disengage from their respective female components to allow the male components to be withdrawn and separated from the female components to cause extension of connecting bridges and to cause substantially simultaneous separation of the front portion from the rear portion about both the waist region and shoulder regions of the protective vest.

* * * * *